United States Patent [19]

Russel et al.

[11] Patent Number: 4,605,298

[45] Date of Patent: Aug. 12, 1986

[54] ELECTROGRAPHIC TRANSFER ROLLER DRIVE MECHANISM

[75] Inventors: Matthew J. Russel; Rose M. Borruso, both of Rochester, N.Y.

[73] Assignee: Eastman Kodak Company, Rochester, N.Y.

[21] Appl. No.: 728,017

[22] Filed: Apr. 29, 1985

[51] Int. Cl.[4] ..... G03G 15/14

[52] U.S. Cl. ..... 355/3 TR; 101/217; 74/392

[58] Field of Search ..... 355/3 TR, 14 TR, 3 BG, 355/16, 3 R; 101/216, 217, 232; 74/392, 397, 399, 401, 403

[56] References Cited

U.S. PATENT DOCUMENTS

| | | | |
|---|---|---|---|
| 2,865,288 | 12/1958 | Kaldschmidt . | |
| 3,247,790 | 4/1966 | Nash . | |
| 3,329,068 | 7/1967 | Pullen . | |
| 3,680,481 | 8/1972 | Sternberg | 101/232 |
| 3,926,118 | 12/1975 | Preuss . | |
| 4,287,409 | 9/1981 | Auchinleck . | |
| 4,330,194 | 5/1982 | Murakami | 355/16 X |
| 4,437,754 | 3/1984 | Idstein | 355/3 TR |

*Primary Examiner*—Arthur T. Grimley
*Assistant Examiner*—J. Pendegrass
*Attorney, Agent, or Firm*—Lawrence P. Kessler

[57] ABSTRACT

Drive mechanism for an electrographic transfer roller apparatus wherein potential degradation of a transferred image is substantially prevented by eliminating relative movement between a receiver member supported by such apparatus and a transferable image carrying dielectric member in contact in a transfer zone. In the drive mechanism, a dielectric member is supported and moved through a transfer zone. A selective drive for the transfer roller is coupled to the transfer roller when a receiver member, supported by the transfer roller, is out of the transfer zone and decoupled from the transfer roller when the attached receiver member is in contact with the dielectric member in the transfer zone. Therefore, when the receiver member and the moving dielectric member are in contact in the transfer zone, drive is imparted only through such contact and the receiver member and dielectric member move at the same peripheral surface speed.

13 Claims, 6 Drawing Figures

FIG. 1
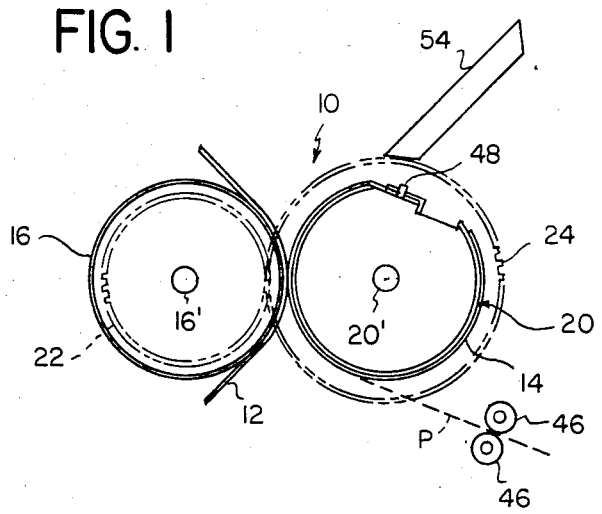
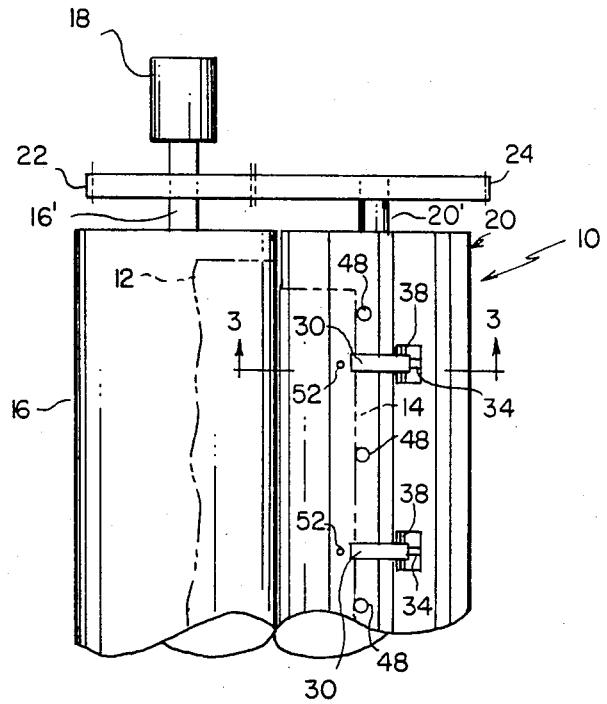
FIG. 2

ELECTROGRAPHIC TRANSFER ROLLER DRIVE MECHANISM

BACKGROUND OF INVENTION

This invention relates generally to electrographic transfer apparatus, and more particularly to a drive mechanism for an electrographic transfer roller apparatus.

In the operation of a typical electrographic reproduction apparatus, a dielectric member, such as a rotatable drum or movable web, is transported about a continuous path into operative relation with electrographic process stations to make information reproductions. During the reproduction process carried out at such process stations of the reproduction apparatus, the dielectric member is uniformly charged and then exposed to an image of information to be reproduced (e.g., reflected light image of a document or electrostatically formed image) to form an electrostatic charge pattern on the member corresponding image-wise to such information. The charge pattern is developed, for example, with pigmented thermoplastic marking particles electrostatically attracted to the charge pattern to form a transferable image on the dielectric member. The transferable image is then transferred from the dielectric member to a receiver member, such as a cut sheet of plain bond paper for example, to form the information reproduction, and the dielectric member is cleaned for reuse.

One technique used to transfer the transferable image from the dielectric member to the receiver member is to transport the receiver member along a path between the dielectric member and a roller urged into contact with the dielectric member. An electrical potential is applied to the roller and establishes an electrostatic field between the roller and the dielectric member. The electrostatic field causes the marking particles of the transferable image to be attracted to the receiver member, the particles adhering to the receiver member as the member leaves the dielectric member. Generally, the transport of the receiver member during transfer is accomplished by attaching the receiver member to the roller upstream of the transfer zone, and rotatably driving the roller to feed the attached receiver member through such zone.

Drive for the transfer roller is positively related to drive for the dielectric transfer member to enable the receiver member, attached to the roller, to be registered relative to transferable image on the dielectric member and to move the roller and dielectric member at the same peripheral speed through the transfer zone. However, the peripheral speed of the surface of the receiver member attached to the roller is slightly greater than the peripheral speed of the roller. Thus different thicknesses in receiver members result in different member peripheral surface speeds. Therefore, matching of the peripheral surface speed of the receiver member and the peripheral speed of the dielectric member is difficult to achieve; and, a mismatch in such peripheral speeds may cause degradation of the transferred image such as by smearing of the image. Such image degradation is, of course, amplified when a plurality of transferable images are transferred to a receiver member as when making multicolor reproductions. Furthermore, any nonuniformities in the positive drive relation will disturb the transfer process which also causes defects in the transferred image.

SUMMARY OF THE INVENTION

This invention is directed to a drive mechanism for an electrographic transfer roller apparatus wherein potential degradation of a transferred image is substantially prevented by eliminating relative movement between a receiver member supported by such apparatus and a transferable image carrying dielectric member in contact in a transfer zone. In the drive mechanism, a dielectric member is supported and moved through a transfer zone. A selective drive for the transfer roller is coupled to the transfer roller when a receiver member, supported by the transfer roller, is out of the transfer zone and decoupled from the transfer roller when attached receiver member is in contact with the dielectric member in the transfer zone. Therefore, when the receiver member and the moving dielectric member are in contact in the transfer zone, drive is imparted only through such contact and the receiver member and the dielectric member move at the same peripheral surface speed.

The invention, and its objects and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which:

FIG. 1 is a side elevational view of the transfer roller and its drive mechanism according to this invention;

FIG. 2 is a top plan view of the structure of FIG. 1;

DESCRIPTION OF THE PREFERRED EMBODIMENT

Figure 3:
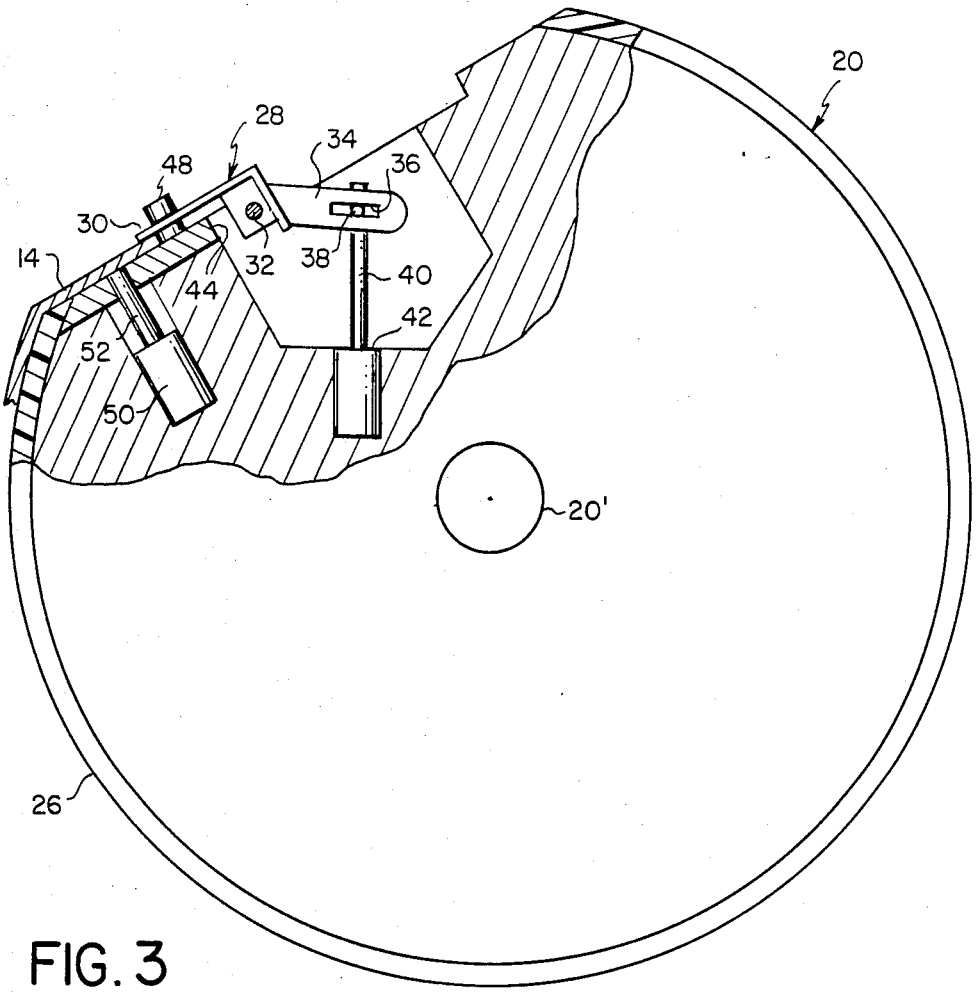
FIG. 3 is a side elevational view, partly in section and on an enlarged scale, of a portion of the transfer roller taken substantially along lines 3—3 of FIG. 2.

Referring to the accompanying drawings, FIG. 1 shows apparatus 10 for transferring a marking particle image carried by a dielectric web 12 to a receiver member 14. The dielectric member 12, which receives the marking particle image by known electrographic techniques, is entrained over a substantially cylindrical support roller 16. The roller 16 is mounted on shaft 16' which is in turn coupled to a motor 18 (see FIG. 2). The motor rotates the roller for transporting the web 12 through the zone in which transfer takes place.

The transfer apparatus 10 includes a substantially cylindrical roller 20 mounted on a shaft 20'. The shaft 20' is parallel to the shaft 16' and spaced therefrom such that the respective longitudinal axes of the shafts are spaced apart a distance substantially equal to the sum of the radii of the rollers 16 and 20 plus the thickness of the dielectric member and the receiver member. A gear 22 fixed on the shaft 16' is in mesh with a gear 24 fixed on shaft 20'. As such, rotation of the roller 16 by the motor 18 effects rotation of the roller 20 in the manner to be described hereinbelow.

The roller 20 has a sleeve 26 (see FIGS. 2, 3, 3a) adapted to be selectively coupled to an electrical potential source (not shown) to provide an electrostatic field for transferring a marking particle image from the web 12 to a receiver member 14 supported on the sleeve. In order to support the receiver member securely on the sleeve 26 during transfer, the roller 20 includes a clamp mechanism 28 (see FIGS. 3, 3a) located in a segment S of the roller formed by a chord C cutting the roller. The clamp mechanism 28 comprises a plurality of fingers 30 (one shown in FIGS. 3, 3a) mounted in spaced relation along a pivot shaft 32 supported by the roller parallel to the shaft 20'. The fingers 30 have arms 34 extending respectively therefrom in a direction opposite to the direction of the fingers. Slots 36, respectively defined in the arms 34, receive an actuating shaft 38. The actuating shaft 38 is coupled, for example, to a rod 40 of a solenoid 42.

Figure 3A:
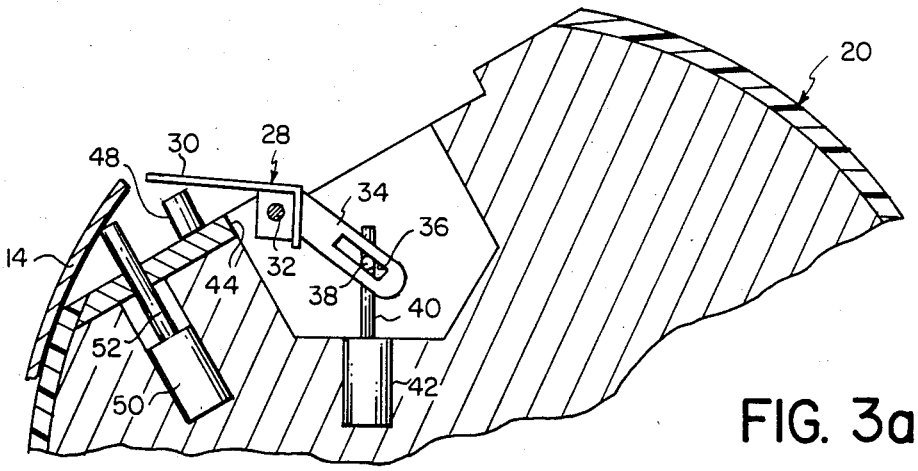
FIG. 3*a* is a side elevational view, similar to FIG. 3, of a portion of the transfer roller showing release of a receiver member from the roller.

Actuation of the solenoid 42 reciprocates rod 42 along its longitudinal axis to laterally move the shaft 38. Movement of the shaft 38 acts on the side walls of the slots 36 to pivot arms 34 about the shaft 32. Pivoting of the arms 34 causes the fingers 30 respectively to pivot about shaft 32 to a first position (FIG. 3a) or a second position (FIG. 3). In the first position the fingers 30 are located to receive or release a receiver member 14; and in the second position, the fingers clamp the receiver member to an anvil 44 located along a portion of the chord of the roller 20.

To clamp a receiver member 14 to the roller 20, such member is transported along a path P (see FIG. 1) by drive rollers 46 in timed relation to rotation of the roller 20. The timing of the transport of the receiver member is selected so that when the anvil 44 is substantially coincident with an extension of the path P, the lead edge of the receiver member slides over the anvil into engagement with registration pins 48 extending from the anvil. The linear velocity of the transported receiver member is greater than the angular velocity of the pins to assure that the member registers against the pins. Once the lead edge of the receiver member is registered against the pins 48, solenoid 42 is activated to move the fingers 30 from their first position to their second position to clamp the lead edge of the member to the anvil 44. On continued rotaton of the roller 20, the receiver member 14 wraps around the sleeve 26 for transport with the roller 20. If necessary the trail edge of the receiver member may also be clamped to the sleeve 26. Such trail edge clamping may be effected by mechanical or vacuum means (not shown).

The rotation of the roller 20 transports the receiver member 14 through the zone where the receiver member is in intimate contact with the web 12 for transfer of a marking particle image from the web to the receiver member under the influence of the electrical potential generated electrostatic field. As noted above, rotation of the roller 20 is normally effected by the driving of gear 24 by gear 22. If, however, gear drive were permitted during the image transfer, there is potential for gear chatter which manifests itself as defects in the transferred image. If alternate drive mechanisms are employed for rotation of the roller 20, nonuniformities in such drives similarly may result in defects in a transferred image. Moreover, when a receiver member is clamped to the surface of the rotating roller 20, the overall diameter is increased, with a corresponding increase in the peripheral speed of the surface of the receiver member. This may cause smearing of the transferred image due to relative speed differential between the web 12 and the receiver member in the transfer zone. Therefore, during transfer the positive gear drive for the roller 20 is selectively interrupted and roller drive is accomplished solely by nip pressure between the web and the receiver member.

Figure 4:
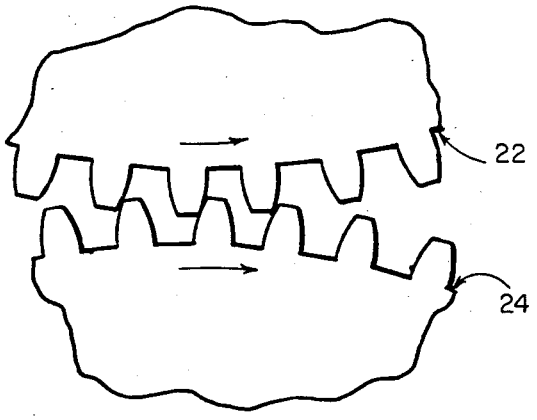
FIG. 4 is a side elevational view of a portion of the drive mechanism of FIG. 1 at one stage of operation.
Figure 4A:
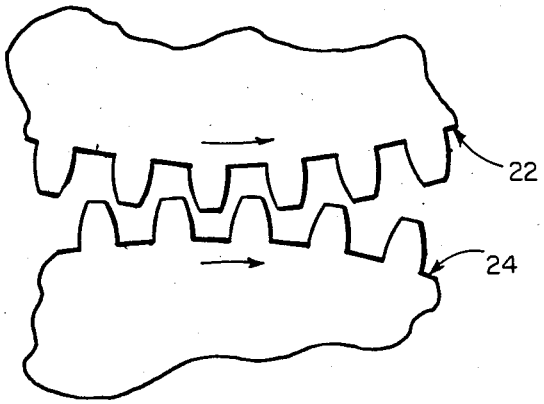
FIG. 4*a* is a side elevational view, similar to FIG. 4, of a portion of the drive mechanism at a different stage of operation.

To accomplish such nip pressure drive, the gears 22 and 24 are sized so that the pitch diameter of gear 24 is greater than the diameter of roller 20 and the pitch diameter of gear 22 is less than the diameter of roller 16. Further, the center-to-center spacing of the gears is slightly greater than normal design spacing. Therefore, the gears mesh along a line different from their normal designed line of action. Additionally, the teeth of one or both of the gears 22 and 24 may be undercut. The increased gear center-to-center spacing and/or the undercut of the gear teeth produce a relatively high degree of backlash in the gear set. Accordingly, under drive conditions where the receiver member is out of the transfer nip, teeth of gear 22 mesh with the teeth of gear 24 (see FIG. 4) to drive the roller 20. However, when the receiver member is in the transfer nip in pressure relation to the web, the increased overall diameter of the roller 20 increases the angular velocity of the roller and thus the gear 24. This causes the teeth of gear 24 to speed up and move in a forward direction away from the teeth of gear 22 (see FIG. 4a). Drive for the roller 20 is then dependent solely upon nip pressure between the web 12 and the receiver member supported by the roller so that the web and the receiver member move at the same peripheral surface speed. Thus relative movement between the web and receiver member is prevented and potential for image degrading gear chatter (or other drive nonuniformities) is eliminated.

It is, of course, clear that in order to accomplish gear chatter prevention the spacing between adjacent teeth of gear 22 must be sufficient to accommodate full forward movement of an included tooth of gear 24 without recontact occurring between the gear teeth. The amount of forward movement of the gear 24 during nip pressure drive can be calculated as follows:

$$\Delta\theta = \frac{S_2}{r_1} - \frac{S_2}{r_2},$$

where, $\Delta\theta$=amount of forward movement (in radians);

$S_1$=length of contact between receiver member and web;

$S_2$=length of receiver member (measured in direction of foward movement);

$r_1$=radius to pitch diameter of the gear associated with the web supporting roller; and $r_2$=radius to pitch diameter of the gear associated with the receiver member supporting transfer roller.

Since $S_1=S_2$, then $$\Delta\theta = \frac{S_2(r_2 - r_1)}{r_1 r_2},$$

The value of $\Delta\theta$ can be readily calculated for a particular receiver member length and radii to the respective pitch diameters. From the value of $\Delta\theta$, tooth spacing for gear 22 can then be determined (i.e., tooth spacing is equal to a distance slightly greater than the sum of $\Delta\theta$ and the width of a tooth of gear 24 taken at its pitch diameter).

As rotation of the roller 20 continues, the receiver member 14 is transported through the transfer zone for complete transfer of a marking particle image from the web 12 to the receiver member. If multiple images are to be transferred to the receiver member in superposition (e.g., in making a multicolor reproduction), such receiver member remains clamped to the roller and is recirculated a requisite number of times corresponding to the number of images to be transferred. When the lead edge of the clamped receiver member clears the transfer zone after initiation of the last transfer to be effected, such lead edge is released to enable such member to be transported to a downstream location where the transferred image(s) is fixed to the member by heat and/or pressure.

To release the lead edge of the receiver member 14 from the roller 20, solenoid 42 is activated to move the fingers 30 from their second position to their first position. Thereafter, a plurality of solenoids 50 (one shown in FIG. 3*a*) are activated to extend a plurality of pins 52 respectively through the anvil 44. The pins 52, located beneath the lead edge of a clamped receiver member, urge the lead edge away from the roller 20 in a direction where the lead edge clears registration pins 48, and continued rotation of the roller transports the member to a transport apparatus 54. The apparatus 54 then directs the receiver member along a desired path toward the downstream fixing location. With the fingers 30 located in their first position, continued rotation of the roller 20 brings the clamping mechanism 28 to an angular location where a subsequent receiver member may be received and clamped to the roller 20 and the transfer process can be repeated.

The invention has been described in detail with particular reference to a preferred embodiment thereof, but it will be understood that variations and modifications can be effected within the spirit and scope of the invention.

I claim:

1. In an electrographic reproduction apparatus wherein a transferable image is carried by a moving dielectric member and transferred from such dielectric member to a receiver member supported by a transfer roller when such transfer roller brings such receiver member into contact with such image in a transfer zone, mechanism for driving said transfer roller in relation with the moving dielectric member, said mechanism comprising:

means, located relative to the transfer roller, for supporting a dielectric member and moving said dielectric member through the transfer zone in transfer relation with a receiver member supported by said transfer roller;

means for selectively driving said transfer roller; and means for coupling said selective drive means to said transfer roller when a receiver member supported by said transfer roller is out of the transfer zone, and for decoupling said selective drive means from said transfer roller when such receiver member is in contact with said dielectric member in the transfer zone, whereby drive for said transfer roller is imparted thereto only through contact of such receiver member with said moving dielectric member and such receiver member and dielectric member move at the same peripheral surface speed.

2. The invention of claim 1 wherein said selective drive means is operatively connected to said dielectric member moving means.

3. The invention of claim 2 wherein said dielectric member moving means comprises a support roller about which said dielectric member is at least partially entrained, and a motor coupled to said roller for rotating said roller about its longitudinal axis.

4. The invention of claim 3 wherein the diameter of said support roller and the diameter of said transfer roller are substantially equal, and the center-to-center spacing of said rollers is substantially equal to the sum of the radii of said rollers plus the thickness of the dielectric member and a receiver member, whereby a receiver member supported by said transfer roller is brought into contact with said dielectric member in the transfer zone by rotation of said transfer roller.

5. The invention of claim 4 wherein said selective drive means comprises a first gear coupled to said support roller for rotation with such roller about the longitudinal axis thereof, and said coupling means includes a second gear coupled to said transfer roller for rotation about the longitudinal axis of said transfer roller, said second gear being in mesh with said first gear and having backlash between the respective teeth of such gears, whereby, when said transfer roller is driven by contact of the receiver member with the moving dielectric member, the teeth of said second gear move away from the teeth of said first gear to decouple the drive of said transfer roller by said first gear.

6. The invention of claim 5 wherein the amount of backlash is greater than the sum of the movement of the teeth of said second gear relative to the teeth of said first gear and the width of a tooth of said second gear measured at the pitch diameter of said second gear.

7. The invention of claim 6 wherein the center-to-center spacing between said gears is such that when in mesh the line of action of said gears is spaced from a normal line of action between such gears to establish backlash.

8. The invention of claim 7 wherein the pitch diameter of said first gear is less than the diameter of said support roller, the pitch diameter of said second gear is greater than the diameter of said transfer roller.

9. The invention of claim 6 wherein the teeth of at least one of said gears are undercut to establish backlash.

10. Apparatus for transferring a transferable image carried by a moving dielectric member from such dielectric member to a receiver member, said apparatus comprising:

a transfer roller for supporting a receiver member and moving such receiver member through a transfer zone;

means for moving a dielectric member through the transfer zone and into contact with such receiver member;

means for selectively driving the transfer roller, said driving means being effective to drive said transfer roller to bring a supported receiver member into initial contact with such dielectric member in the transfer zone and, thereafter, ineffective for driving said transfer roller when such receiver member is in the transfer zone, whereby such receiver member and transfer roller are driven only by contact with such dielectric member, the receiver member and dielectric member traveling at the same peripheral surface speed.

11. The invention of claim 10 wherein said selective drive means is operatively connected to said dielectric member moving means.

12. The invention of claim 11 wnerein said dielectric member moving means includes a support roller about which said dielectric member is at least partially entrained, and a motor coupled to said roller for rotating said roller about its axis.

13. The invention of claim 12 wherein said selective drive means comprises of first gear coupled to said support roller for rotation with such roller about the longitudinal axis thereof, and second gear coupled to said transfer roller for rotation with said transfer roller about the longitudinal axis thereof, said second gear being in mesh with said first gear to be driven by said first gear and having backlash between the respective teeth of such gears, whereby when said transfer roller is driven by contact with the moving dielectric member, the teeth of said second gear move away from the teeth of said first gear so that said first gear does not drive said second gear.

* * * * *